US012648676B2

(12) United States Patent
Li et al.

(10) Patent No.: US 12,648,676 B2
(45) Date of Patent: Jun. 9, 2026

(54) LIQUID DISTRIBUTOR

(71) Applicant: Xiamen Lota International Co., Ltd., Xiamen (CN)

(72) Inventors: Hao Li, Xiamen (CN); Liming Ye, Xiamen (CN); Yan Zhang, Xiamen (CN); Chuanbao Zhu, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 184 days.

(21) Appl. No.: 18/610,334

(22) Filed: Mar. 20, 2024

(65) Prior Publication Data

US 2025/0194863 A1 Jun. 19, 2025

(30) Foreign Application Priority Data

Dec. 13, 2023 (CN) ..... 202311715356.9

(51) Int. Cl.
*A47K 5/12* (2006.01)

(52) U.S. Cl.
CPC ..... *A47K 5/1217* (2013.01); *A47K 5/1211* (2013.01); *A47K 2005/1218* (2013.01)

(58) Field of Classification Search
CPC ..... B05B 11/1087; B05B 11/1097; B05B 11/1052; A47K 5/1211; A47K 5/1217; A47K 2005/1218; A47K 5/14; A47K 5/1205; A47K 5/16
USPC ..... 222/333, 52, 173, 190, 63
See application file for complete search history.

(56) References Cited

U.S. PATENT DOCUMENTS 6,467,651 B1 * 10/2002 Muderlak ..... B05B 12/02 222/63
6,915,816 B2 * 7/2005 Nelson ..... E03C 1/04 137/355.23
8,220,492 B2 * 7/2012 Lin ..... E03C 1/0401 137/315.12
9,133,607 B2 * 9/2015 Schoolcraft ..... E03C 1/057
2009/0084813 A1 * 4/2009 Chen ..... A47K 5/1217 222/52
2009/0101679 A1 * 4/2009 Muderlak ..... A47K 5/16 222/375
2009/0152293 A1 * 6/2009 Sayers ..... A47K 5/1205 222/173

(Continued)

FOREIGN PATENT DOCUMENTS

CN 201855196 U 6/2011
CN 202698987 U 1/2013

*Primary Examiner* — Charles P. Cheyney
(74) *Attorney, Agent, or Firm* — Cooper Legal Group, LLC

(57) ABSTRACT

A liquid distributor comprises a body, a fixed seat, a liquid supply mechanism, a sensing mechanism, and a liquid container. The fixed seat is configured to be fixedly disposed on a countertop, and the body is detachably connected to an upper part of the fixed seat to be disposed above the countertop. The liquid supply mechanism is detachably connected to a lower part of the fixed seat so as to be disposed below the countertop, and the liquid supply mechanism at least comprises a degree of rotational freedom relative to an axis of the fixed seat. The liquid container is connected to the liquid supply mechanism, and the sensing mechanism is disposed on the body. The liquid supply mechanism comprises a pump body, a liquid suction port, a liquid supply port, a power connector, and a sensing line connector.

13 Claims, 8 Drawing Sheets

(56) References Cited

U.S. PATENT DOCUMENTS

| | | | | |
|---|---|---|---|---|
| 2011/0215115 | A1* | 9/2011 | Proper | B67D 7/76 222/173 |
| 2013/0341358 | A1* | 12/2013 | Ciavarella | B05B 11/1087 222/190 |
| 2014/0027468 | A1* | 1/2014 | Lin | A47K 5/16 222/63 |
| 2014/0124540 | A1* | 5/2014 | Ciavarella | B05B 7/0037 222/173 |

* cited by examiner

LIQUID DISTRIBUTOR

RELATED APPLICATIONS

This application claims priority to Chinese patent application number 202311715356.9, filed on Dec. 13, 2023. Chinese patent application number 202311715356.9 is incorporated herein by reference.

FIELD OF THE DISCLOSURE

The present disclosure relates to a liquid distributor, in particular to a sensing liquid distributor that is convenient for under-counter installation.

BACKGROUND OF THE DISCLOSURE

With the development of automation technology, more and more daily necessities have automated functions, and automatic soap dispensers are one of them. Chinese patent CN201855196U provides a desktop soap dispenser with automatic control function. After a sensing system issues a command, a soap suction mechanism suctions soap liquid from a soap liquid bottle through a suction pipe and transports it to a table faucet for dispensing. In order to facilitate adding soap liquid, the applicant applied for Chinese patent CN202698987U, which discloses an electronic soap dispenser, which comprises a soap dispenser head with a liquid outlet, a sensing seat connected to a lower part of the soap dispenser head, a mounting seat, a liquid supply system, a connecting seat, and a soap bottle. The sensing seat is fixedly mounted on the mounting seat, and a lower part of the mounting seat is connected to the connecting seat. A lower part of the connecting seat is connected to the soap bottle, and the liquid supply system is fixedly connected to the connecting seat. A liquid outlet pipe in the soap dispenser head passes through the sensing seat and the mounting seat in sequence and penetrates into the connecting seat. The sensing seat comprises a liquid inlet chamber penetrating through the sensing seat along a vertical direction. The mounting seat is formed with a liquid inlet pipe that corresponds to the liquid inlet chamber. The connecting seat is formed with a liquid inlet channel that corresponds to the liquid inlet pipe to be connected to the soap bottle. However, after the liquid supply system is fixedly connected to the connecting seat, an upper end of the liquid supply system is connected to the mounting seat, and the lower end of the liquid supply system is threadedly connected to the soap bottle. Since an installation space under the countertop is small and the liquid supply system protrudes from the connecting seat, the installer needs to manually adjust a direction of the liquid supply system and then to tighten the liquid supply system with a connecting nut. After the connecting nut is locked, the position of the liquid supply system cannot be adjusted. Moreover, if additional pipelines or signal lines are needed on the liquid supply system, it will be troublesome to install each line and pipeline under the countertop.

BRIEF SUMMARY OF THE DISCLOSURE

The present disclosure provides a sensing liquid distributor that is convenient for under-counter installation to solve the deficiencies in the background.

In order to solve the technical problem, a first technical solution of the present disclosure is as follows.

A liquid distributor comprises a body, a fixed seat, a liquid supply mechanism, a sensing mechanism, and a liquid container. The fixed seat is configured to be fixedly disposed on a countertop, and the body is detachably connected to an upper part of the fixed seat to be disposed above the countertop. The liquid supply mechanism is detachably connected to a lower part of the fixed seat so as to be disposed below the countertop, and the liquid supply mechanism at least comprises a degree of rotational freedom relative to an axis of the fixed seat. The liquid container is connected to the liquid supply mechanism, and the sensing mechanism is disposed on the body. The liquid supply mechanism comprises a pump body, a liquid suction port, a liquid supply port, a power connector, and a sensing line connector. The pump body is connected to the liquid suction port and the liquid supply port, and the power connector is connected to the pump body and the sensing line connector. The liquid suction port is fluidly connected to the liquid container, and the body comprises a liquid outlet pipe connected to a liquid outlet of the body and a sensing line connected to the sensing mechanism. The liquid outlet pipe is detachably connected to the liquid supply port, and the sensing line is detachably connected to the sensing line connector. The power connector is configured to be detachably connected to a power supply.

In a preferred embodiment, a lower end of the fixed seat comprises an annular groove, and the liquid supply mechanism comprises an insertion port and a movable snap ring. The lower end of the fixed seat is configured to be disposed in the insertion port, and the movable snap ring is configured to be moved between an engaged position and a separated position. When the movable snap ring is in the engaged position, the movable snap ring at least partially protrudes inward from an inner wall of the insertion port to extend into the annular groove to inhibit axial movement of the fixed seat relative to the liquid supply mechanism.

In a preferred embodiment, the insertion port comprises a plurality of notches arranged at intervals along a circumferential direction of the insertion port, and the movable snap ring comprises a plurality of protrusions arranged at intervals along the circumferential direction of the insertion port. When the plurality of protrusions are in the engaged position, the plurality of protrusions respectively extend into the insertion port from the plurality of notches to extend into the annular groove.

In a preferred embodiment, a locking block is formed between two adjacent notches of the plurality of notches, a locking groove is formed between two adjacent protrusions of the plurality of protrusions, and the locking block is correspondingly disposed in the locking groove.

In a preferred embodiment, the movable snap ring is rotatably connected to an outer wall of the insertion port.

In a preferred embodiment, the liquid supply port of the liquid supply mechanism comprises a surrounding wall protruding outward, and an upper end of the surrounding wall comprises a plurality of fitting slots arranged at intervals along a circumferential direction of the surrounding wall. A bottom of each of the plurality of fitting slots comprises an extension groove extending a certain distance along the circumferential direction of the surrounding wall, and a distal end of the liquid outlet pipe comprises a liquid inlet joint. A plurality of fitting blocks are arranged on an outer peripheral wall of the liquid inlet joint at intervals along the circumferential direction of the surrounding wall, and the plurality of fitting blocks are disposed in the plurality of fitting slots so that the plurality of fitting blocks are configured to be rotated at a certain angle in the circumferential direction of the surrounding wall to be connected to the extension grooves. A distal end of each of the plurality of fitting blocks is connected to a handle, and when the plurality of fitting blocks are disposed in the extension grooves, the handle is located outside the surrounding wall.

In a preferred embodiment, a spring tube is sleeved outside the liquid outlet pipe.

In a preferred embodiment, the liquid supply mechanism comprises an insertion port, and a lower end of the fixed seat is detachably disposed in the insertion port. The insertion port penetrates through the liquid supply mechanism in vertical direction, and a lower end of insertion port is detachably connected to the liquid container. The fixed seat comprises a liquid supply channel penetrating through the fixed seat in the vertical direction. When the fixed seat is connected to the liquid supply mechanism: the insertion port is connected to the liquid supply channel in the vertical direction, and an upper end of the fixed seat forms an inlet of the liquid supply channel. When the body is separated from the upper end of the fixed seat, the inlet of the liquid supply channel is exposed.

In a preferred embodiment, an outer peripheral wall of the fixed seat comprises a channel extending along an axial direction of the fixed seat, and the liquid outlet pipe and the sensing line extend in the channel and pass from below the countertop to above the countertop.

In a preferred embodiment, an upper end of the fixed seat comprises a plurality of first rotary buckles arranged at intervals along a circumferential direction of the fixed seat, and a lower end of the body comprises a plurality of second rotary buckles arranged along the circumferential direction of the body. The body is configured to be rotated to enable the plurality of first rotary buckles and the plurality of second rotary buckles to be engaged with or separated from each other.

Compared with the existing techniques, the technical solution has the following advantages.

1. The liquid supply mechanism at least comprises a degree of rotational freedom relative to an axis of the fixed seat. The liquid container is connected to the liquid supply mechanism, and the sensing mechanism is disposed on the body. The liquid supply mechanism comprises a pump body, a liquid suction port, a liquid supply port, a power connector, and a sensing line connector. The pump body is connected to the liquid suction port and the liquid supply port, and the power connector is connected to the pump body and the sensing line connector. The liquid suction port is fluidly connected to the liquid container, and the body comprises a liquid outlet pipe connected to a liquid outlet of the body and a sensing line connected to the sensing mechanism. The liquid outlet pipe is detachably connected to the liquid supply port, the sensing line is detachably connected to the sensing line connector, and the power connector is configured to be detachably connected to a power supply. The position of the liquid supply mechanism is easy to adjust and easy to install under the countertop.

2. A lower end of the fixed seat comprises an annular groove, and the liquid supply mechanism comprises an insertion port and a movable snap ring. The lower end of the fixed seat is configured to be disposed in the insertion port, and the movable snap ring is configured to be moved between an engaged position and a separated position. When the movable snap ring is in the engaged position, the movable snap ring at least partially protrudes inward from an inner wall of the insertion port to extend into the annular groove to inhibit axial movement of the fixed seat relative to the liquid supply mechanism. The connection between the fixed seat and the liquid supply mechanism is quick and convenient, which are easy to install under the countertop.

3. The liquid supply port of the liquid supply mechanism comprises a surrounding wall protruding outward, and an upper end of the surrounding wall comprises a plurality of fitting slots arranged at intervals along a circumferential direction of the surrounding wall. A bottom of each of the plurality of fitting slots comprises an extension groove extending a certain distance along the circumferential direction of the surrounding wall, and a distal end of the liquid outlet pipe comprises a liquid inlet joint. A plurality of fitting blocks are arranged on an outer peripheral wall of the liquid inlet joint at intervals along the circumferential direction of the surrounding wall, and the plurality of fitting blocks are disposed in the plurality of fitting slots so that the plurality of fitting blocks are configured to be rotated at a certain angle in the circumferential direction of the surrounding wall to be connected to the extension grooves. A distal end of each of the plurality of fitting blocks is connected to a handle, and when the plurality of fitting blocks are disposed in the extension grooves, the handle is located outside the surrounding wall. The liquid outlet pipe is easy to install.

4. The liquid supply mechanism comprises an insertion port, and a lower end of the fixed seat is detachably disposed in the insertion port. The insertion port penetrates through the liquid supply mechanism in vertical direction, and a lower end of insertion port is detachably connected to the liquid container. The fixed seat comprises a liquid supply channel penetrating through the fixed seat in the vertical direction. When the fixed seat is connected to the liquid supply mechanism, the insertion port is connected to the liquid supply channel in the vertical direction, and the upper end of the fixed seat forms an inlet of the liquid supply channel. When the body is separated from the upper end of the fixed seat, the inlet of the liquid supply channel is exposed. This arrangement is convenient for filling the liquid container.

DETAILED DESCRIPTION OF THE EMBODIMENTS

Figure 1:
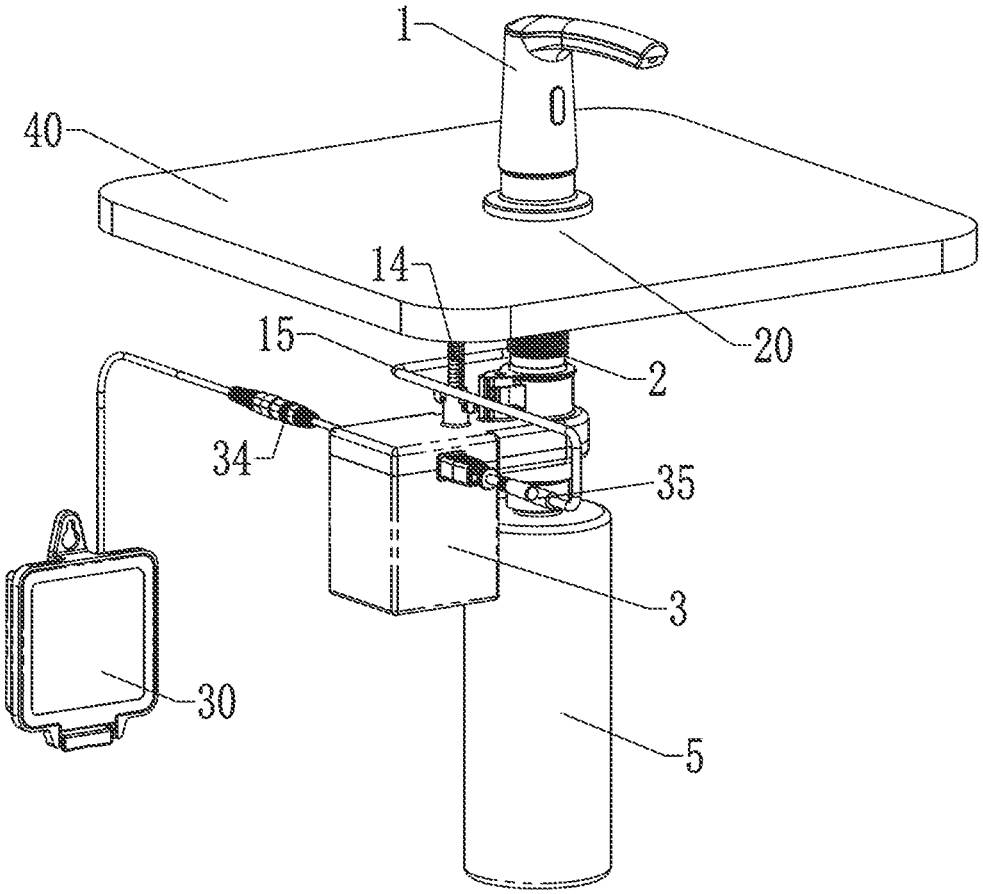
FIG. 1 illustrates a perspective view of a liquid distributor that is mounted on a countertop in a preferred embodiment in the present disclosure.
Figure 2:
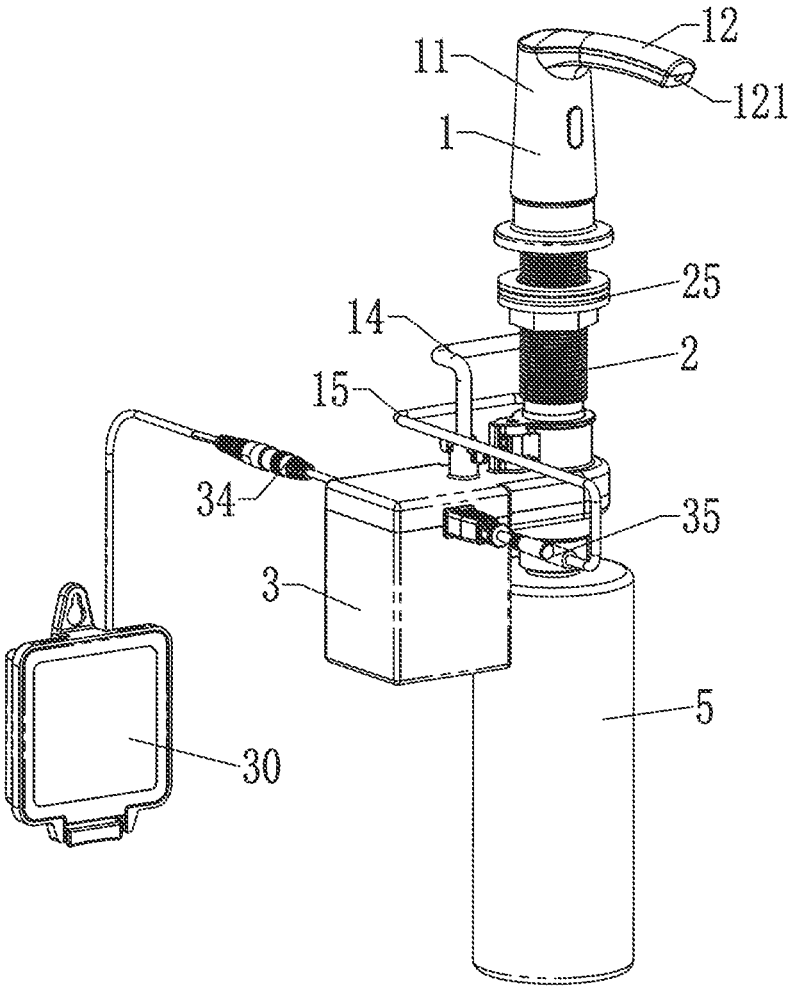
FIG. 2 illustrates a perspective view of the liquid distributor in the preferred embodiment in the present disclosure.
Figure 3:
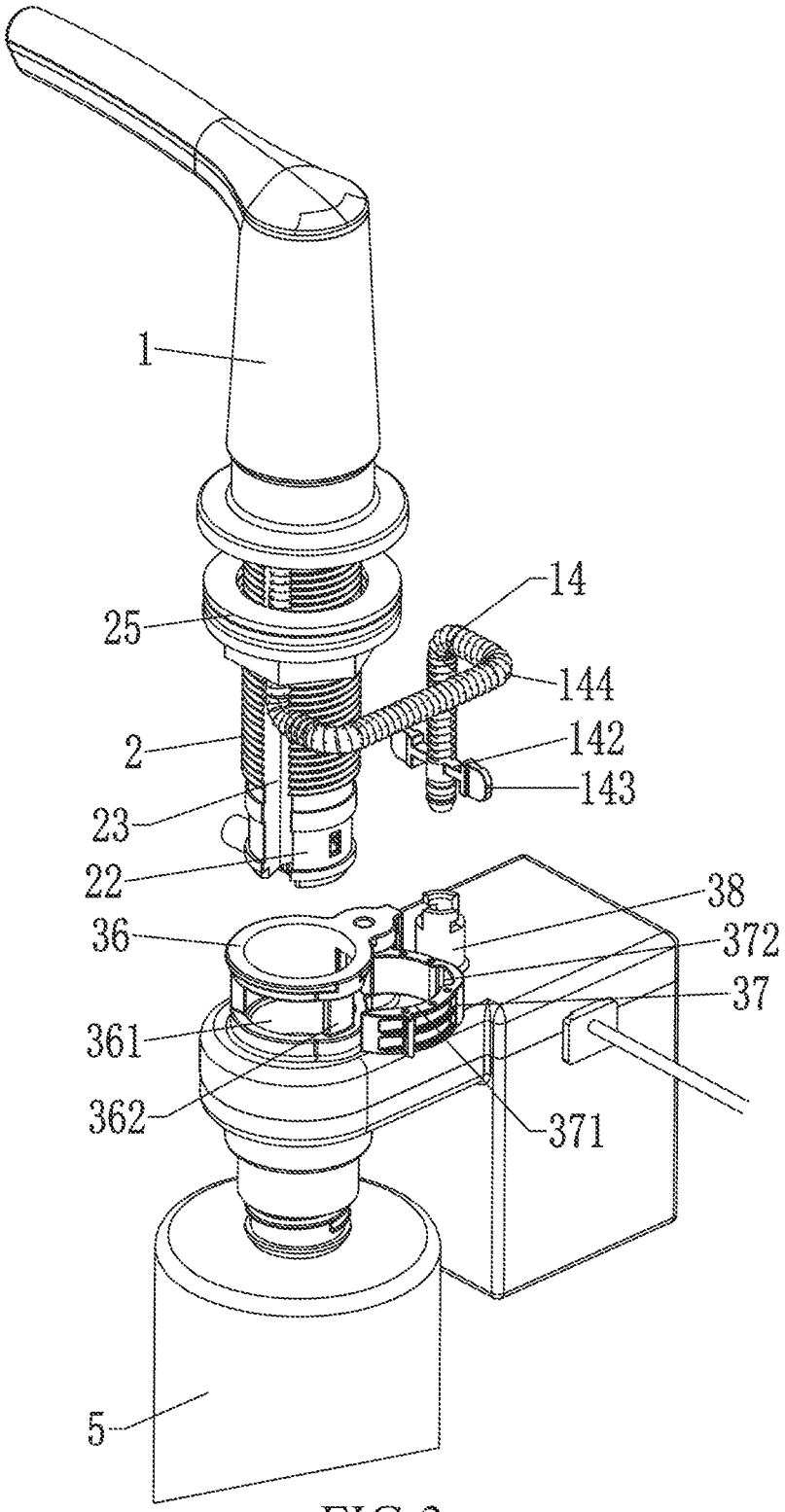
FIG. 3 illustrates an exploded and perspective view of the liquid distributor before a liquid supply mechanism is connected to a fixed seat in the preferred embodiment in the present disclosure.
Figure 4:
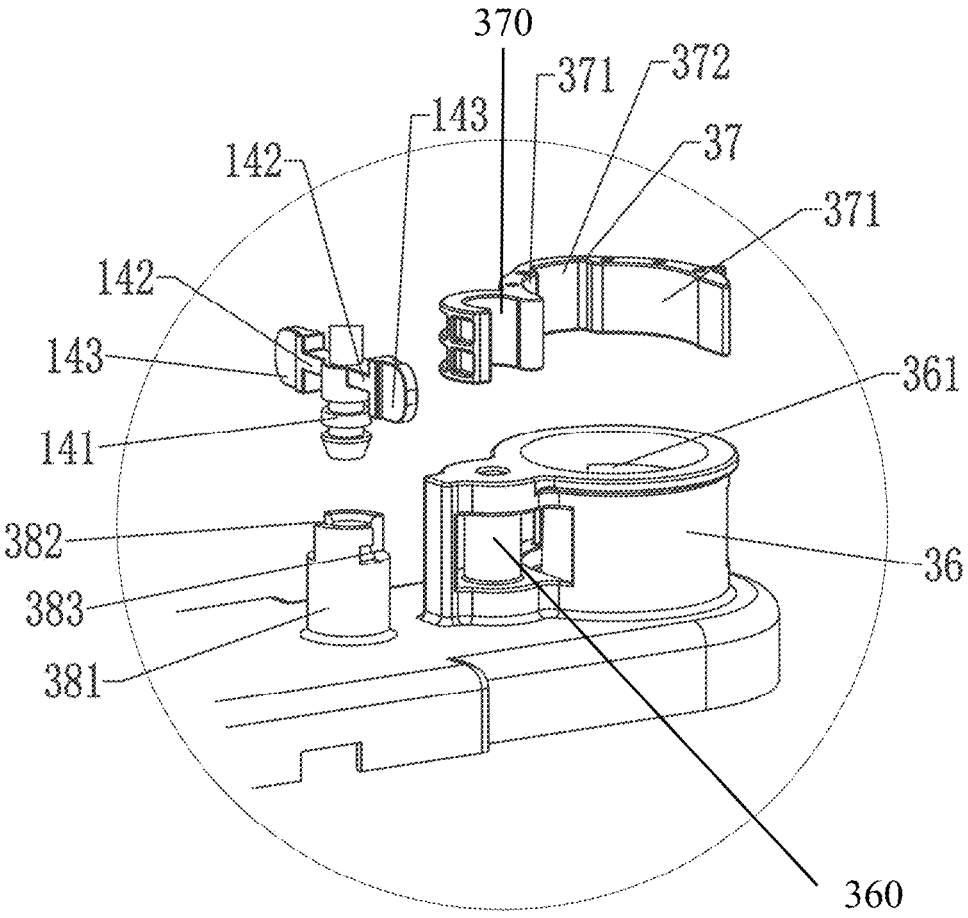
FIG. 4 illustrates an exploded and perspective view of the liquid distributor before a liquid outlet pipe is connected to a liquid supply port in the preferred embodiment in the present disclosure.
Figure 5:
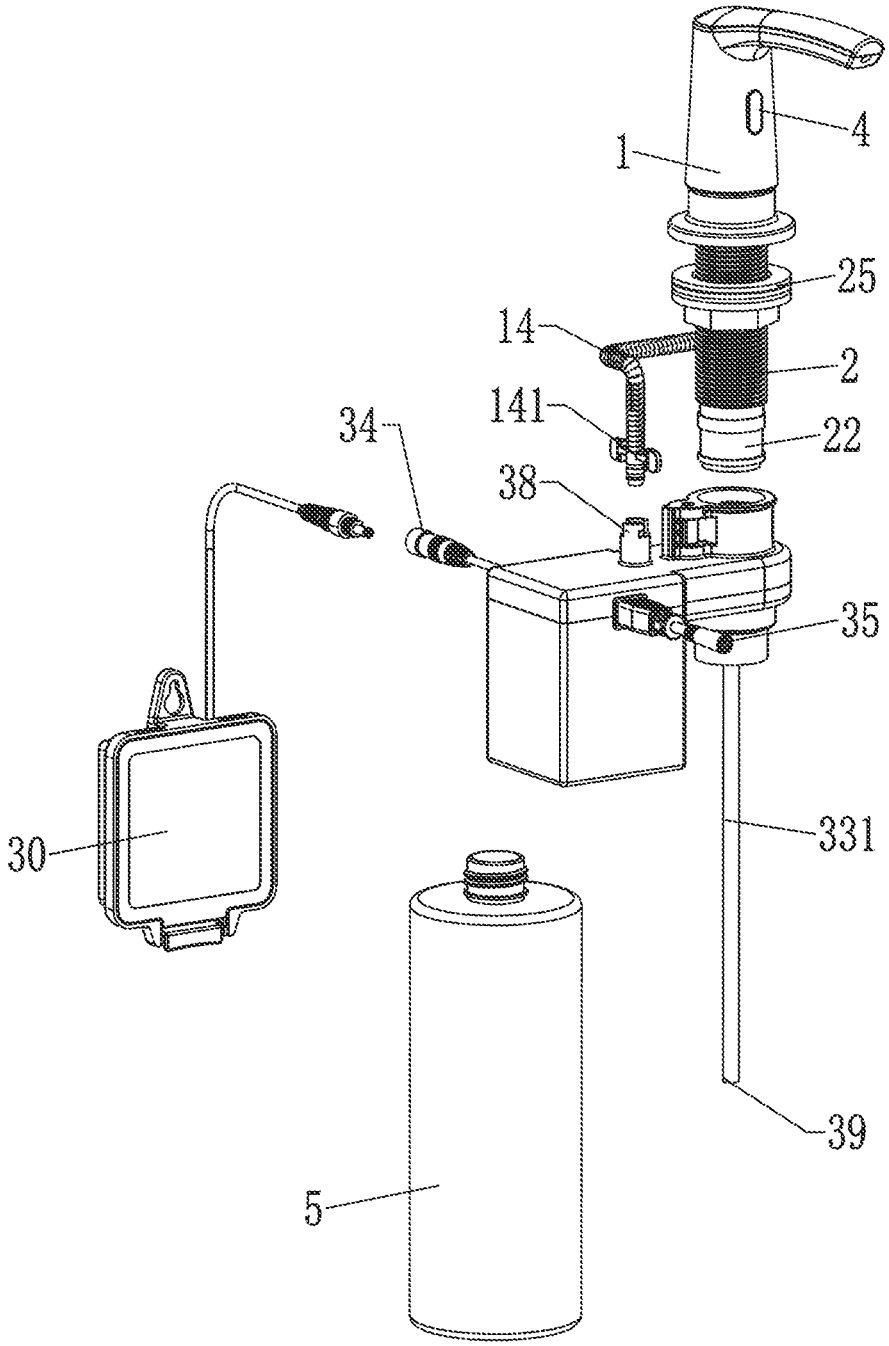
FIG. 5 illustrates an exploded and perspective view of the liquid distributor in the preferred embodiment in the present disclosure.
Figure 6:
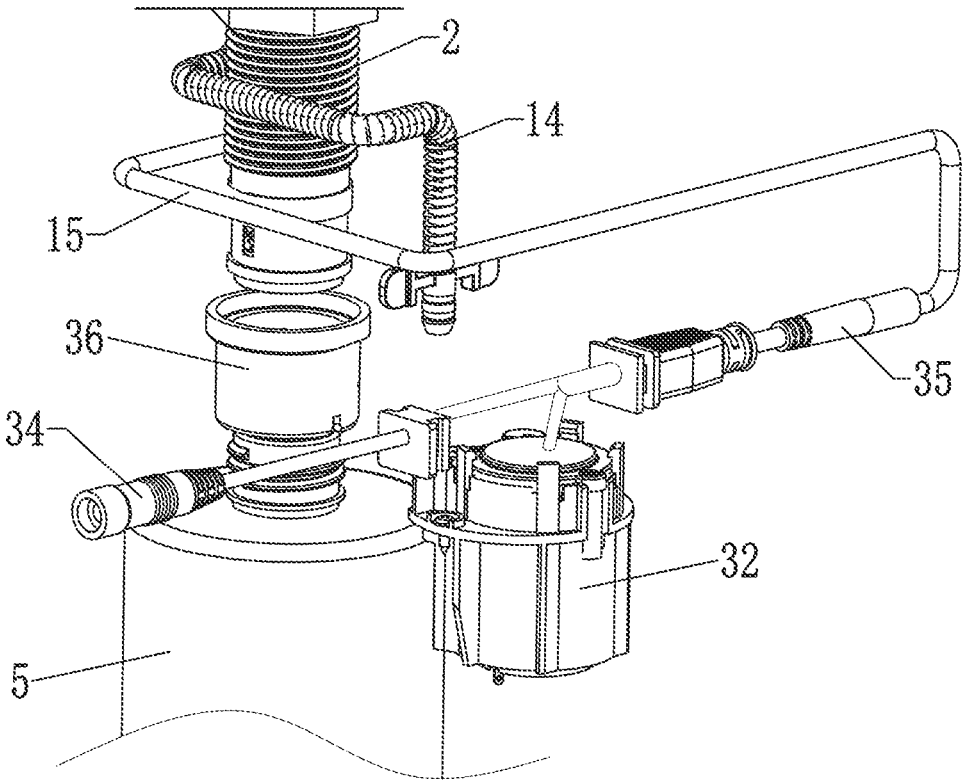
FIG. 6 illustrates an exploded and perspective view of an inside cable of the liquid supply mechanism in the preferred embodiment in the present disclosure.
Figure 7:
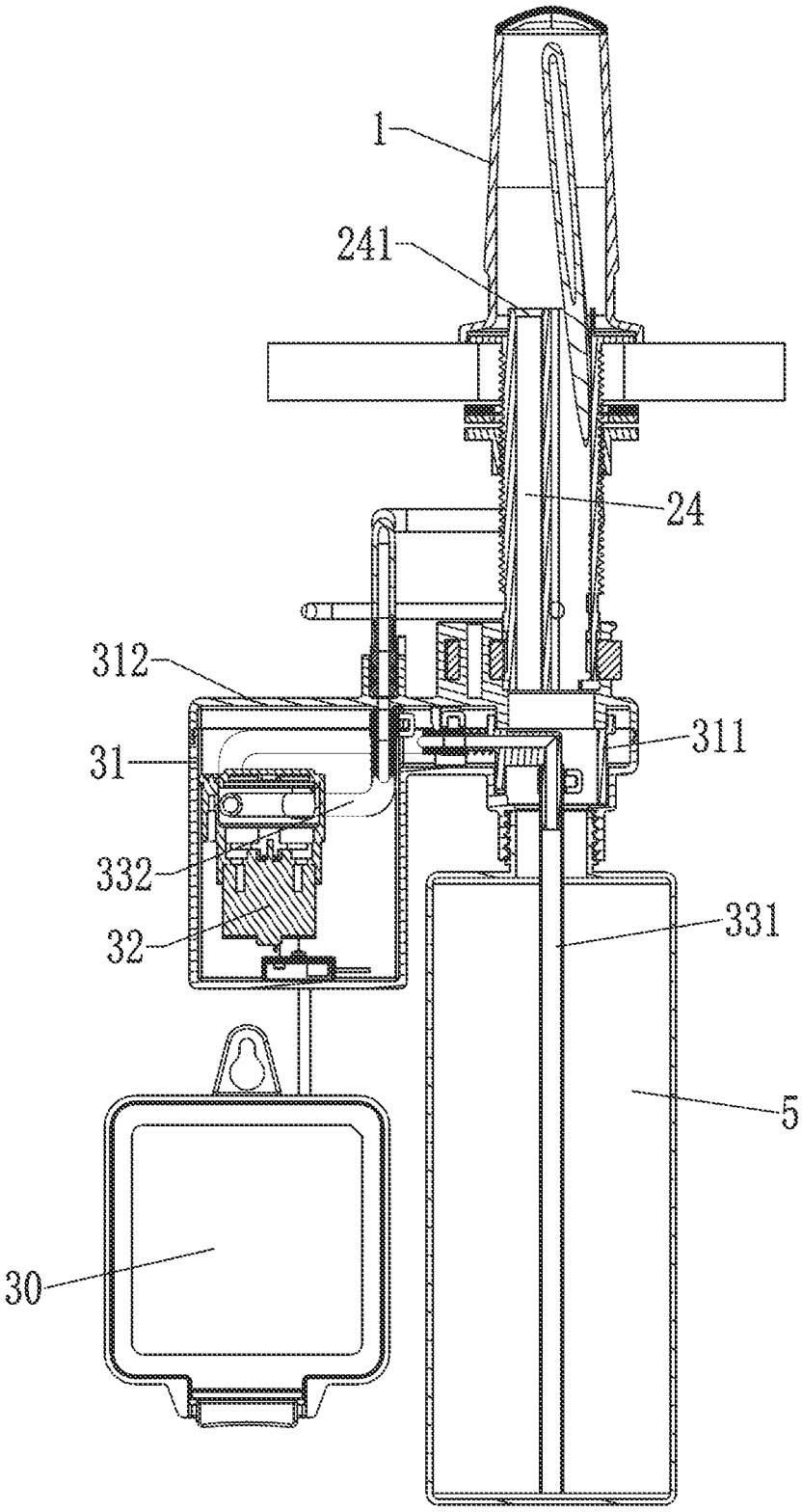
FIG. 7 illustrates a cross-sectional view of the liquid distributor in the preferred embodiment in the present disclosure.
Figure 8:
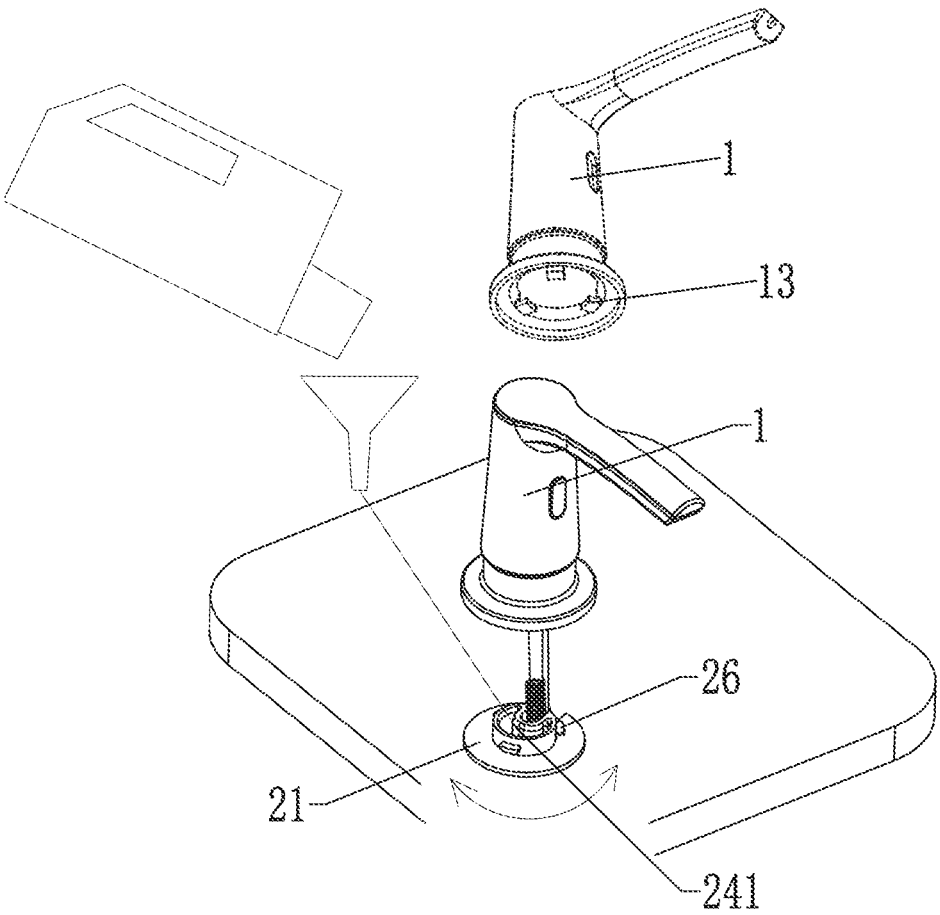
FIG. 8 illustrates a perspective view of a body having been detached from the fixed seat while a liquid supply channel is filled with a liquid using a funnel in the preferred embodiment in the present disclosure.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

A liquid distributor comprises a body 1, a fixed seat 2, a liquid supply mechanism 3, a sensing mechanism 4, and a liquid container 5. In this embodiment, the liquid container 5 can contain hand sanitizer, soap liquid, disinfectant liquid, etc.

The body 1 is in a shape of a faucet and comprises a vertical part 11 and a lateral part 12. A first end of the vertical part 11 abuts a countertop 40, and a second end of the vertical part 11 is connected to the lateral part 12. The lateral part 12 extends horizontally and has a liquid outlet 121 at a distal end of the lateral part 12. A side of the vertical part 11 facing the lateral part 12 comprises a sensing window.

The fixed seat 2 is in a shape of a threaded tube. An upper end of the fixed seat 2 comprises a flange 21. A lower end of the fixed seat 2 can pass through a mounting hole 20 on the countertop 40. The lower end of the fixed seat 2 corresponds to a lower space located below the countertop 40. The lower end of the fixed seat 2 comprises an annular groove 22. An outer peripheral wall of the fixed seat 2 further comprises a channel 23 extending along an axial direction of the fixed seat 2, and the channel 23 at least extends to connect an upper space located above the countertop 40 and the lower space located below the countertop 40. A liquid supply channel 24 is formed inside the fixed seat 2 and penetrates through the fixed seat 2 in a vertical direction. An inlet 241 of the liquid supply channel 24 is located at the upper end of the fixed seat 2. After the lower end of the fixed seat 2 passes through the mounting hole 20, a fixed cover 25 is screwed to the fixed seat 2 from the lower end of the fixed seat 2 so as to be pressed on a lower side of the countertop 40, and the flange 21 is pressed on an upper side of the countertop 40.

The body 1 is detachably connected to the upper end of the fixed seat 2 to be arranged above the countertop 40. Specifically, an outer wall of a part of the fixed seat 2 that exceeds the flange 21 forms a plurality of first rotary buckles 26 arranged at intervals along a circumferential direction of the fixed seat 2, and an inner side of a lower end of the vertical part 11 of the body 1 forms a plurality of second rotary buckles 13 arranged at intervals along the circumferential direction of the fixed seat 2. The body 1 rotates relative to the upper end of the fixed seat 2 so that the plurality of first rotary buckles 26 and the plurality of second rotary buckles 13 can be coupled to or separated from each other. When the body 1 is separated from the fixed seat 2, the inlet 241 of the liquid supply channel 24 is exposed.

The liquid supply mechanism 3 comprises a housing 31 and a pump body 32 disposed in the housing 31. The pump body 32 is a peristaltic pump or the like. The housing 31 comprises a connecting part 311 and a mounting part 312. An upper side of the connecting part 311 is connected to the fixed seat 2, and a lower side of the connecting part 311 is connected to the liquid container 5. The pump body 32 is disposed in the mounting part 312. The liquid supply mechanism 3 further comprises a first pipeline 331 and a second pipeline 332 which are disposed in the housing 31. A first end of the first pipeline 331 is connected to a liquid suction end of the pump body 32, and a second end of the first pipeline 331 extends downward from the lower side of the connecting part 311 to be inserted into the liquid container 5. The second end of the first pipeline 331 forms a liquid suction port 39 of the liquid supply mechanism 3. A first end of the second pipeline 332 is connected to a liquid outlet end of the pump body 32, and the second end of the second pipeline 332 is connected to an upper side of the housing 31 of the liquid supply mechanism 3 to form a liquid supply port 38 of the liquid supply mechanism 3.

The liquid supply mechanism 3 further comprises a power connector 34 and a sensing line connector 35. The power connector 34 is disposed on a first side of the housing 31, and the sensing line connector 35 is disposed on a second side of the housing 31. The body 1 comprises a liquid outlet pipe 14 connected to the liquid outlet 121 and a sensing line 15 connected to the sensing mechanism 4. The liquid outlet pipe 14 is detachably connected to the liquid supply port 38. The sensing line 15 is detachably connected to the sensing line connector 35, and the power connector 34 is configured to be detachably connected to a power supply 30. In this embodiment, the sensing mechanism 4 is disposed on the sensing window, and the sensing mechanism 4 may be an infrared sensor or the like. The power connector 34 is configured to receive power to drive the pump body 32 and the sensing mechanism 4 to work. The power supply 30 is an external battery, and the sensing line connector 35 is connected to the pump body 32 and a controller. The controller controls the pump body 32 through the sensing mechanism 4 to realize automatic liquid pumping.

The liquid supply mechanism 3 is detachably connected to the lower end of the fixed seat 2 to be disposed under the countertop 40. The liquid supply mechanism 3 at least comprises a degree of rotational freedom relative to an axis of the fixed seat 2. During installation, the fixed seat 2 can be fixed on the countertop 40 first, and then the liquid supply mechanism 3 is connected to the lower end of the fixed seat 2 since the liquid supply mechanism 3 has the degree of rotational freedom relative to the axis of the fixed seat 2. Moreover, the liquid suction port 39, the liquid supply port 38, the power connector 34, and the sensing line connector 35 are all provided on the liquid supply mechanism 3. Therefore, in subsequent installation, the liquid outlet pipe 14, the power supply 30, and the sensing line 15 can be installed and connected in sequence, which is convenient for installation when a space under the countertop 40 is small, and the installation is quick and easy.

The upper side of the connecting part 311 of the liquid supply mechanism 3 comprises an insertion port 36, a positioning rod 360, and a movable snap ring 37. A first end of the movable snap ring 37 comprises a circular ring 370 having an opening, and the circular ring 370 is sleeved over the positioning rod 360 through the opening. The lower end of the fixed seat 2 is configured to be inserted into the insertion port 36. The movable snap ring 37 is configured to move between an engaged position and a separated position. When in the engaged position, the movable snap ring 37 at least partially protrudes inward from an inner wall of the insertion port 36 to extend into the annular groove 22 to inhibit axial movement of the fixed seat 2 relative to the liquid supply mechanism 3. The insertion port 36 comprises a plurality of notches 361 spaced apart from one another along the circumferential direction of the insertion port 36, and the movable snap ring 37 comprises a plurality of protrusions 371 spaced apart from one another along the circumferential direction of the insertion port 36. When in the engaged position, the plurality of protrusions 371 respectively extend into the insertion port 36 from the plurality of notches 361 to extend into the annular groove 22. A locking block 362 is formed between two adjacent notches 361 of the plurality of notches 361, and a locking groove 372 is formed between two adjacent protrusions 371 of the plurality of protrusions 371. The locking block 362 is correspondingly inserted into the locking groove 372. In this embodiment, the movable snap ring 37 is rotatably connected to an outer wall of the insertion port 36. During installation, as long as the lower end of the fixed seat 2 is inserted into the insertion port 36, the movable snap ring 37 is then rotated so that the plurality of protrusions 371 of the movable snap ring 37 are inserted into the annular groove 22. That is, inhibiting of the axial movement of the fixed seat 2 relative to the insertion port 36 can be realized, and at this time, the insertion port 36 has a degree of rotational freedom relative to the fixed seat 2.

The liquid supply port 38 of the liquid supply mechanism 3 comprises a surrounding wall 381 protruding outward. An upper end of the surrounding wall 381 comprises a plurality of fitting slots 382 arranged at intervals along a circumferential direction of the surrounding wall 381. A bottom of each of the plurality of fitting slots 382 comprises an extension groove 383 extending a certain distance along the circumferential direction of the surrounding wall 381. A distal end of the liquid outlet pipe 14 comprises a liquid inlet joint 141, and a plurality of fitting blocks 142 are arranged on an outer peripheral wall of the liquid inlet joint 141 at intervals along the circumferential direction of the surrounding wall 381. The plurality of fitting blocks 142 are inserted into the plurality of fitting slots 382 and are then rotated at a certain angle in the circumferential direction of the surrounding wall 381 to be connected to the extension grooves 383. A distal end of each of the plurality of fitting blocks 142 is connected to a handle 143. When the plurality of fitting blocks 142 are inserted into the extension grooves 383, the handle 143 is located outside the surrounding wall 381. During installation, the liquid supply mechanism 3 can be rotated so that the liquid supply port 38 can be moved to a position closer to a user or to a position at which the liquid inlet joint 141 is easier to install, and then the liquid inlet joint 141 is inserted into the surrounding wall 381 of the liquid supply port 38 until the plurality of fitting blocks 142 correspond to the extension grooves 383. The user can push the handle 143 so that the plurality of fitting blocks 142 are moved into the extension grooves 383. During disassembly, the handle 143 can also be pushed to achieve disassembly.

A spring tube 144 is sleeved outside the liquid outlet pipe 14. The spring tube 144 can protect the liquid outlet pipe 14 and prevent the liquid outlet pipe 14 from being blocked due to the liquid outlet pipe 14 being bent. The spring tube 144 can also protect a pipeline direction of the liquid outlet pipe 14.

The insertion port 36 penetrates through the connecting part 311 of the liquid supply mechanism 3 in the vertical direction, and a lower end of the insertion port 36 is detachably connected to the liquid container 5. In this embodiment, the lower end of the insertion port 36 is threaded to the liquid container 5. When the fixed seat 2 is connected to the liquid supply mechanism 3, the insertion port 36 is connected to the liquid supply channel 24 in the vertical direction, and the upper end of the fixed seat 2 forms the inlet 241 of the liquid supply channel 24. When the body 1 is detached from the fixed seat 2, the inlet 241 of the liquid supply channel 24 is exposed.

The liquid outlet pipe 14 and the sensing line 15 extend in the channel 23 and pass from below the countertop 40 to above the countertop 40.

During installation, the liquid outlet pipe 14 is first connected to the liquid outlet 121, and the sensing mechanism 4 is installed on the sensing window. The liquid outlet pipe 14 and the sensing line 15 are correspondingly extended in the channel 23, and then the body 1 and the fixed seat 2 are connected. The lower end of the fixed seat 2 corresponds to and passes through the mounting hole 20 until the flange 21 abuts the upper side of the countertop 40. The fixed cover 25 is installed from the lower end of the fixed seat 2 and is rotated so as to be adjusted to abut the lower side of the countertop 40. The liquid container 5 is connected to the liquid supply mechanism 3. The insertion port 36 of the liquid supply mechanism 3 corresponds to and is inserted into the lower end of the fixed seat 2, and the movable snap ring 37 is rotated so that the movable snap ring 37 is snapped to the annular groove 22. At this time, the liquid supply mechanism 3 can rotate relative to the fixed seat 2. The position of the liquid supply mechanism 3 can be adjusted, the liquid outlet pipe 14, the sensing line 15, and the power supply 30 can be respectively connected to the liquid supply mechanism 3, and the installation is completed.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A liquid distributor, comprising:

a body, a fixed seat, a liquid supply mechanism, a sensing mechanism, and a liquid container, wherein:

the fixed seat is configured to be fixedly disposed on a countertop, the body is detachably connected to an upper part of the fixed seat to be disposed above the countertop, the liquid supply mechanism is detachably connected to a lower part of the fixed seat so as to be disposed below the countertop, the liquid supply mechanism at least comprises a degree of rotational freedom relative to an axis of the fixed seat, the liquid container is connected to the liquid supply mechanism, the sensing mechanism is disposed on the body, the liquid supply mechanism comprises a pump body, a liquid suction port, a liquid supply port, a power connector, and a sensing line connector, the pump body is connected to the liquid suction port and the liquid supply port, the power connector is connected to the pump body and the sensing line connector, the liquid suction port is fluidly connected to the liquid container, the body comprises a liquid outlet pipe connected to a liquid outlet of the body and a sensing line connected to the sensing mechanism, the liquid outlet pipe is detachably connected to the liquid supply port, the sensing line is detachably connected to the sensing line connector, the power connector is configured to be detachably connected to a power supply, a lower end of the fixed seat comprises an annular groove, the liquid supply mechanism comprises an insertion port, a positioning rod, and a movable snap ring, a first end of the movable snap ring comprises a circular ring disposed within the movable snap ring and having an opening, the lower end of the fixed seat is configured to be disposed in the insertion port, the movable snap ring is configured to be moved between an engaged position and a separated position, the circular ring is sleeved over the positioning rod through the opening, and when the movable snap ring is in the engaged position, the movable snap ring at least partially protrudes inward from an inner wall of the insertion port to extend into the annular groove to inhibit axial movement of the fixed seat relative to the liquid supply mechanism.

2. The liquid distributor according to claim 1, wherein:

the insertion port comprises a plurality of notches arranged at intervals along a circumferential direction of the insertion port, the movable snap ring comprises a plurality of protrusions arranged at intervals along the circumferential direction of the insertion port, and when the plurality of protrusions are in the engaged position, the plurality of protrusions respectively extend into the insertion port from the plurality of notches to extend into the annular groove.

3. The liquid distributor according to claim 2, wherein:

a locking block is formed between two adjacent notches of the plurality of notches, a locking groove is formed between two adjacent protrusions of the plurality of protrusions, and the locking block is correspondingly disposed in the locking groove.

4. The liquid distributor according to claim 2, wherein:

the movable snap ring is rotatably connected to an outer wall of the insertion port.

5. The liquid distributor according to claim 1, wherein:

the liquid supply port of the liquid supply mechanism comprises a surrounding wall protruding outward, an upper end of the surrounding wall comprises a plurality of fitting slots arranged at intervals along a circumferential direction of the surrounding wall, a bottom of each of the plurality of fitting slots comprises an extension groove extending a certain distance along the circumferential direction of the surrounding wall, a distal end of the liquid outlet pipe comprises a liquid inlet joint, a plurality of fitting blocks are arranged on an outer peripheral wall of the liquid inlet joint at intervals along the circumferential direction of the surrounding wall, the plurality of fitting blocks are disposed in the plurality of fitting slots so that the plurality of fitting blocks are configured to be rotated at a certain angle in the circumferential direction of the surrounding wall to be connected to the extension grooves, a distal end of each of the plurality of fitting blocks is connected to a handle, and when the plurality of fitting blocks are disposed in the extension grooves, the handle is located outside the surrounding wall.

6. The liquid distributor according to claim 1, wherein:

a spring tube is sleeved outside the liquid outlet pipe.

7. The liquid distributor according to claim 1, wherein:

the lower end of the fixed seat is detachably disposed in the insertion port, the insertion port penetrates through the liquid supply mechanism in a vertical direction, a lower end of insertion port is detachably connected to the liquid container, the fixed seat comprises a liquid supply channel penetrating through the fixed seat in the vertical direction, when the fixed seat is connected to the liquid supply mechanism:

the insertion port is connected to the liquid supply channel in the vertical direction, and an upper end of the fixed seat forms an inlet of the liquid supply channel, and when the body is separated from the upper end of the fixed seat, the inlet of the liquid supply channel is exposed.

8. The liquid distributor according to claim 1, wherein:

an outer peripheral wall of the fixed seat comprises a channel extending along an axial direction of the fixed seat, and the liquid outlet pipe and the sensing line extend in the channel and pass from below the countertop to above the countertop.

9. The liquid distributor according to claim 1, wherein:

an upper end of the fixed seat comprises a plurality of first rotary buckles arranged at intervals along a circumferential direction of the fixed seat, a lower end of the body comprises a plurality of second rotary buckles arranged along a circumferential direction of the body, and the body is configured to be rotated to enable the plurality of first rotary buckles and the plurality of second rotary buckles to be engaged with or separated from each other.

10. The liquid distributor according to claim 3, wherein: the movable snap ring is rotatably connected to an outer wall of the insertion port.

11. The liquid distributor according to claim 5, wherein: a spring tube is sleeved outside the liquid outlet pipe.

12. A liquid distributor, comprising:

a body, a fixed seat, a liquid supply mechanism, a sensing mechanism, and a liquid container, wherein:

the fixed seat is configured to be fixedly disposed on a countertop, the body is detachably connected to an upper part of the fixed seat to be disposed above the countertop, the liquid supply mechanism is detachably connected to a lower part of the fixed seat so as to be disposed below the countertop, the liquid supply mechanism at least comprises a degree of rotational freedom relative to an axis of the fixed seat, the liquid container is connected to the liquid supply mechanism, the sensing mechanism is disposed on the body, the liquid supply mechanism comprises a pump body, a liquid suction port, a liquid supply port, a power connector, and a sensing line connector, the pump body is connected to the liquid suction port and the liquid supply port, the power connector is connected to the pump body and the sensing line connector, the liquid suction port is fluidly connected to the liquid container, the body comprises a liquid outlet pipe connected to a liquid outlet of the body and a sensing line connected to the sensing mechanism, the liquid outlet pipe is detachably connected to the liquid supply port, the sensing line is detachably connected to the sensing line connector, the power connector is configured to be detachably connected to a power supply, the liquid supply port of the liquid supply mechanism comprises a surrounding wall protruding outward, an upper end of the surrounding wall comprises a plurality of fitting slots arranged at intervals along a circumferential direction of the surrounding wall, a bottom of each of the plurality of fitting slots comprises an extension groove extending a certain distance along the circumferential direction of the surrounding wall, a distal end of the liquid outlet pipe comprises a liquid inlet joint, a plurality of fitting blocks are arranged on an outer peripheral wall of the liquid inlet joint at intervals along the circumferential direction of the surrounding wall, the plurality of fitting blocks are disposed in the plurality of fitting slots so that the plurality of fitting blocks are configured to be rotated at a certain angle in the circumferential direction of the surrounding wall to be connected to the extension grooves, a distal end of each of the plurality of fitting blocks is connected to a handle, and when the plurality of fitting blocks are disposed in the extension grooves, the handle is located outside the surrounding wall.

13. The liquid distributor according to claim 1, wherein: the circular ring is configured to rotate around the positioning rod.

* * * * *